US009963942B2

(12) United States Patent
Eidem et al.

(10) Patent No.: US 9,963,942 B2
(45) **Date of Patent: *May 8, 2018**

(54) CENTRALIZER

(71) Applicant: Statoil Petroleum AS, Stavanger (NO)

(72) Inventors: Morten Eidem, Trondheim (NO); Tore Weltzin, Stavanger (NO); Gaute Grindhaug, Hafrsfjord (NO); Jafar Abdollahi, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/344,010

(22) Filed: Nov. 4, 2016

(65) Prior Publication Data

US 2017/0074055 A1 Mar. 16, 2017

Related U.S. Application Data

(63) Continuation of application No. 13/978,369, filed as application No. PCT/EP2011/050180 on Jan. 7, 2011, now Pat. No. 9,534,456.

(51) Int. Cl.
*E21B 17/10* (2006.01)

(52) U.S. Cl.
CPC ..... *E21B 17/1078* (2013.01); *E21B 17/105* (2013.01); *E21B 17/1057* (2013.01); *E21B 17/1064* (2013.01)

(58) Field of Classification Search
CPC ..... E21B 17/1078; E21B 17/1064; E21B 17/105; E21B 17/10; E21B 17/1057
See application file for complete search history.

(56) References Cited

U.S. PATENT DOCUMENTS

| | | | | |
|---|---|---|---|---|
| 5,579,854 | A | 12/1996 | Barry | |
| 5,692,562 | A | 12/1997 | Squires | |
| 5,810,100 | A | 9/1998 | Samford | |
| 5,901,798 | A * | 5/1999 | Herrera | E21B 17/105 166/241.3 |
| 6,032,748 | A * | 3/2000 | DeBray | E21B 17/105 166/241.4 |
| 6,209,667 | B1 * | 4/2001 | Murray | E21B 17/105 175/228 |
| 6,453,999 | B1 * | 9/2002 | Reinholdt | E21B 17/1057 166/241.3 |

(Continued)

FOREIGN PATENT DOCUMENTS

| | | |
|---|---|---|
| GB | 2 400 124 A | 10/2004 |
| WO | WO 96/34173 A1 | 10/1996 |

*Primary Examiner* — Brad Harcourt
*Assistant Examiner* — Christopher J Sebesta
(74) *Attorney, Agent, or Firm* — Birch, Stewart, Kolasch & Birch, LLP

(57) ABSTRACT

A centralizer includes a centralizer body to be situated at the outer surface of a pipe string in the form of casing, liner, or the like used while drilling, the centralizer body being formed with a plurality of outer centralizer blades arranged in an inclined manner to the longitudinal axis thereof, wherein the centralizer body has an separate split inner tube secured to the pipe string by means of a press fit, and low friction inner surface of the centralizer body and separate center tube facing each other are made from low friction material.

15 Claims, 3 Drawing Sheets

(56) References Cited

U.S. PATENT DOCUMENTS

| | | | | |
|---|---|---|---|---|
| 6,585,043 | B1 * | 7/2003 | Murray | E21B 17/1057 166/241.3 |
| 9,534,456 | B2 * | 1/2017 | Eidem | E21B 17/105 |
| 2003/0192720 | A1 * | 10/2003 | Mitchell | E21B 17/1007 175/325.3 |
| 2008/0217063 | A1 * | 9/2008 | Moore | E21B 17/1042 175/57 |
| 2010/0252274 | A1 * | 10/2010 | Buytaert | E21B 17/1028 166/380 |
| 2011/0114338 | A1 | 5/2011 | Casassa et al. | |

* cited by examiner

CENTRALIZER

CROSS-REFERENCE TO RELATED APPLICATIONS

This application is a Continuation of copending U.S. application Ser. No. 13/978,369, filed on Jul. 26, 2013, which is a National Stage of International Application No. PCT/EP11/50180, filed on Jan. 7, 2011, all of which are hereby expressly incorporated by reference into the present application.

TECHNICAL FIELD

The present invention relates to a centralizer while drilling and particularly a centralizer for drilling operations by means of a pipe string in the form of casing, liner.

BACKGROUND ART

Several different centralizers exist on the market today wherein most of them have been designed for traditional casing and liner running and are not intended for drilling operations using the same.

When running casing or liner into a borehole the centralizers are used to improve cementing operations and also to reduce friction during such operations. If drilling with centralizers, the centralizer should also protect the pipe string from wear. Low rotational and running friction becomes increasingly important as horizontal displacement increases and drilling with liner and casing develop into a common technique.

Current technologies have a wide assortment of designs and components but the challenges of drilling with centralizers on the pipe string have not been properly considered during construction. This means that current equipment available on the market may cause friction forces between the casing and the borehole which are too high for a drilling application, even with the use of centralizers. The current equipment may also induce concern regarding the wear and integrity of a rotatable pipe string over time.

To be able to meet future well construction demands, there is a need for a centralizer which:

- gives low rotational and sliding resistance;
- protects the pipe string from external wear;
- facilitates tripping, i.e. running a drill string into or pulling it out of a borehole;
- can sustain long periods of rotation with flow; and
- is robust enough to prevent possibility of junk in the borehole.

The providers of centralizers also provide stop collars for locking the centralizers in place. Most of the current products are fastened to the pipe string by a number of bolts or screws through the stop collar body, biting into the surface of the pipe to lock the collars in place to prevent movement.

Recent testing has revealed that existing stop collars have weaknesses and might slide out of position downhole. This is particularly true when used in a liner- or casing-drilling application.

An extended amount of rotation is experienced during drilling operations with a casing or liner. The current means are not designed with drilling in mind and there is a high risk of the stop collars loosing their grip on the casing and starting to move. This causes the centralizers to shift position, which would disrupt the pipe string structure and also have a potential for damaging the pipe string integrity, e.g. with respect to burst and collapse, as the bolts of a loose stop collar can scrape into the outer surface of the pipe string at each rotation. A need exists for an improved design which can

- secure a centraliser in place
- reduce wear on end portion of centraliser
- minimise friction between stop collar and centraliser
- remove risk of reduced casing integrity from protruding bolts

DISCLOSURE OF INVENTION

The above problems have been solved by a centralizer and locking stop collar according to the appended claims.

One main objective of the present invention is to provide a centralizer created specifically for drilling operations with a casing or liner. The invention can also be used for running a casing or liner into extended deviated borehole sections where torque and drag becomes an issue.

This objective can be achieved by means of a centralizer comprising a centralizer body to be situated at the outer surface of a pipe string in the form of a casing or liner used while drilling, the centralizer body being formed with a plurality of outer centralizer blades arranged in an inclined, helical manner to the longitudinal axis of the centralizer body. The number and width of the blades can be varied depending on the application of the centralizer, e.g. the expected load that the blades will be subjected to, the centralizer diameter and the angle of the blade relative to the central axis of the centralizer. The centralizer body further comprises a separate inner tube section secured to the outer surface of the pipe string by means of a press fit and an inner surface consisting of a high friction surface, wherein facing contact surfaces between the centralizer body and its separate inner tube section are made from a suitable low friction material. This material forms a low friction bearing between the components. The separate inner tube section can be made up of a tube section that is split in its longitudinal direction, allowing it to be expanded and slipped over a casing or liner making up the pipe string. In this context, the term "low friction materials" is used for materials that reduce the friction between contacting surfaces in the centralizer assembly. The material should preferably, but not necessarily, be possible to be applied as a coating to a metal surface. Non-excluding examples of suitable materials are low friction polymers, such as Teflon©, polyethylene (PE) Medium-Density Polyethylene (MDPE) and Ultra-high Molecular Weight Polyethylene (UHMWPE).

To improve fixation, the centralizer body is positioned on the pipe string using a pair of stop collars. A stop collar is mounted non-rotatably around the casing or liner at each end of the centralizer body and allows the centralizer body to rotate relative to the stop collars, as well as relative to the inner tube section, substantially without friction.

To enable such a rotation substantially without friction, at least one facing end or contact surface of the centralizer body and/or the stop collar is provided with a coating or a separate, exchangeable annular disc comprising or coated with a suitable low friction material. This material forms a low friction bearing between the components. The end of each stop collar can be mounted in an end-to-end arrangement adjacent a corresponding end of the centralizer body. Alternatively, the end of the stop collar can be accommodated within a recess conforming to the size of the stop collar formed in the centralizer body, in order to protect the facing end or contact surfaces.

To facilitate both sliding into or out of a borehole, the outer centralizer blades are provided with a coating or protruding pad made from a suitable low friction material. The protruding pad is oval formed and shaped to conform with the outer diameter of the borehole. The shape and size of the pads depend on factors such as the diameter of the borehole, the diameter of the centralizer, the location of the pads on the centralizer body radius and the desired radial extension out of the blade.

Alternatively, each outer centraliser blade can comprise of at least one outer protruding portion, extending a predetermined distance radially outwards from said centralizer blades. The predetermined distance that the protruding portions extend radially from said centralizer blades is selected to ensure that the protruding portions prevent the centralizer blades from coming into contact with the borehole. This distance is dependent on the axial length and angle of the centralizer blades, the outer diameter of the centralizer blades and the diameter of the borehole. Each protruding portion can be in the form of a roller, such as a failsafe oval formed roller, i.e. having an oval basic shape, with an outer surface having a minimum diameter at each end and a maximum diameter at its middle section. The roller is journalled in bearings at each end and is arranged with its central axis at right angles to the central axis of the centralizer. The rollers are installed in recesses inside the blades and extend radially outwards through openings in the outer circumferential surface of the blades. These openings are smaller than the roller outer diameter at each point along its length. The shape of the opening is arranged to conform with the outer contour of the roller extending a predetermined radial distance out of the opening.

The edges of an opening can be provided with an overlap, making the length of the opening less than the length of the roller, so that said edges extend over the roller at its respective ends. Similarly, the width of the opening is less than the diameter of the roller at each point along its length, so that these side edges follow the oval shape of the roller along the length of the opening. The tolerances between the edges of the opening and the outer surface of the roller are selected to minimize the risk of material entering the recess. The relatively smaller opening prevents the rollers from falling out into the borehole if the roller bearing axis fails and thus reduces the risk of junk in borehole which can jam the pipe string during drilling or tripping. The number of rollers can be varied depending on the axial length of the blade and/or the expected loading on the centralizer. The shape and size of the rollers depend on factors such as the diameter of the borehole, the diameter of the centralizer, the location of the rollers on the centralizer body radius and the desired radial extension out of the blade.

In other words, during drilling, the present centralizer consists of an inner split tube section which is placed over a section the pipe string at regular intervals. The inner diameter of the tube section is slightly under gauge relative to the outer diameter of a corresponding section of the pipe string. As described above, the tube section is split in its longitudinal direction, allowing it to be expanded and slipped over a casing or liner. The expanded tube section is slipped onto the casing or liner from one end thereof. When the tube section has been moved along the casing or liner into a desired position the tube section is released and allowed to contract over the casing or liner, where it is held in position be a press fit. The split tube section has a high friction inner surface and a low friction outer surface. The high friction inner surface is in direct contact with the casing or liner and assists in holding the tube section in position, allowing it to rotate together with the pipe. The high friction surface can comprise an aggregate coating or a similar suitable material. The low friction outer surface of the split tube is working as a bearing face for the corresponding centraliser body which has a low friction inner surface.

The low friction inner surface of the centraliser is achieved by either use of a suitable low friction material on the inside of the centraliser body or alternatively by the use of a suitable low friction material on the inside of the centraliser body in combination with a centre tube built into the centraliser body and made from a suitable low friction material. The use of a low friction centre tube will create an additional low friction bearing face and thereby create on low friction bearing between the centraliser body and the centre tube and a second low friction bearing between the centre tube and the split tube mounted on the casing or liner.

The use of low friction surfaces between the split tube and the centralizer body minimises the rotational resistance between these components. Creating a low friction rotational surface attached to and separated from the outer surface of the casing or liner, for cooperation with the centralizer body, also assists in preventing wear of this portion of the pipe string during extended periods of rotation and radically increases the burst and collapse integrity.

The centralizer body has an inner low friction surface to reduce rotational friction and is equipped with angled or helically curved blades on its outer surface to give improved circular coverage in contact with the borehole. Oval shaped rollers or, alternatively, oval shaped low friction pads or coating are set into the blades to minimise sliding resistance when moving the pipe string into or pulling it out of a borehole. The oval configuration of the rollers or pads matches the curvature of the borehole outer diameter and gives an even load distribution over the length of the rollers or pads in contact with the borehole. This arrangement avoids point loading on the rollers or pads and reduces the risk of uneven wear or failure.

As described above, the end surfaces of the centralizer body facing the stop collars can be provided with a low friction coating, or be equipped with an annular disc either coated with or comprising a suitable low friction material. The low friction end surfaces will further reduce the rotational resistance of the centralizer, especially when it is simultaneously rotated and moved in the axial direction of the borehole. The ends of the centralizer body can also have an annular recess providing an overlap extending a predetermined axial distance over the outer circumference of the stop collars to reduce the amount of cuttings and particles entering into the low friction bearing surface inside the centralizer body and at the end surfaces of said centralizer body. The recesses at the end of the centralizer body accommodating the stop collars, and if desired the annular discs comprising or coated with a suitable low friction material, can be achieved by allowing the centralizer body to extend axially past the outer ends of the low friction inner surface of said centralizer body, or by machining each end of the centralizer body to form a recess.

The outer ends of each stop collar, which end faces away from the centralizer body, forms a transition between the casing or liner and the main body of the stop collar. This first transition is bevelled, forming a truncated cone, in order to reduce the risk of hang-up on sharp ledges in the borehole and to work as a guide if stepped changes in borehole geometry are encountered. The outer ends of the centralizer body form a transition between the stop collars and the outer diameter of the blades in the longitudinal direction of the centralizer body. This second transition is bevelled, forming a truncated cone, for the same reasons as for the first transition described above.

The aim of the centralizer according to the present invention is to remove any wear between the pipe string and the centralizer while minimising the rotational friction involved when rotating the pipe string. As drilling operations with a casing or liner causes the pipe string to be subjected to long periods of rotation, the integrity of the pipe string becomes a problem. Current technology may have either a potential wear problem, caused by friction between the inner surface of a moving centralizer and the outside of the rotating pipe string surface, or a torque problem, caused by friction between the outer surface of a fixed centralizer and the borehole formation.

A stop collar with a high friction inner surface is fixed firmly to the pipe by tightening a number of fastening screws, which causes a reduction in the stop collar inner diameter. The fastening mechanism ensures that the equipment is kept in the intended fixed position, without the risk of causing wear or damage to the pipe body. The additional low friction end surface on the stop collar facing towards the centralizer body further reduces the rotational restriction of the centralizer as the pipe string is axially displaced in the borehole.

The present invention removes many boundaries of current well construction constraints and enables the construction and execution of extended deviated sections without exceeding the pipe string and surface equipment limitations.

Briefly, the benefits achieved compared to existing technology are as follows:

No wear on the outer surface of the casing—having a tube section with a high friction inner surface and a low friction outer surface attached to the pipe string means that there is no rotational wear on the outside of the rotating pipe string.

Low friction rotational surfaces—rotation occurs between the tube section attached to the casing, the low friction inner tube and the low friction inner surface of the centralizer body. As these surfaces are made of a low friction material, extremely low resistance against rotation is achieved.

Curved blades with rollers, low friction coatings or pads—curved blades on the outer surface of the centralizer body creates an improved coverage of the outer diameter of the borehole, reduces the risk of vibration if rotation of the outer centralizer body occurs, and improves stand off of the pipe string from the interior wall of a borehole. This arrangement is combined with low friction pads or rollers located in the axial direction of the centralizer for minimising the friction against the outside casing or rock formation when running the pipe string in or out of borehole.

Curved rollers or low friction pads on the blades—the rollers or pads are curved to match the wellbore/previous casing inner/outer diameter. The curvature of the rollers or pads leads to an even loading on the roller or pad surface, thereby reducing point loads on the pad or roller and possible uneven wear or failure of the roller bearing.

Low friction material between stop collar and centralizer—facing end surfaces where either or both are provided with a low friction material reduces the rotational resistance for surfaces between the fixed stop collar and the rotatable centralizer.

Stop collar overlap/integration—the stop collar fits into an overlapping recess in the end surface of the centralizer body. This reduces the risk of intrusion of sand/cuttings into the low friction bearing surfaces between stop collar and casing.

Fail safe rollers—rollers installed in fail safe recess with a radially outwards facing opening having a size smaller than the actual roller. This prevents the roller from falling out of the centralizer and possibly jamming against ledges in the borehole.

Stop collars with a high friction inner surface fixed to the pipe string through reduction of the inner diameter of the stop collar when fastening screws are tightened. The fastening mechanism reduces risk of movement during strain and also has an even force distribution against the inner pipe string. This will ensure that no disruption of the integrity of the pipe strength occurs.

In the text of the description, both above and below, the examples may sometimes refer to "a casing". However, it should be understood that drilling operations using an arrangement according to the present invention could be performed using a pipe string in the form of a casing or a liner.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

EMBODIMENTS OF THE INVENTION

Figure 1A:
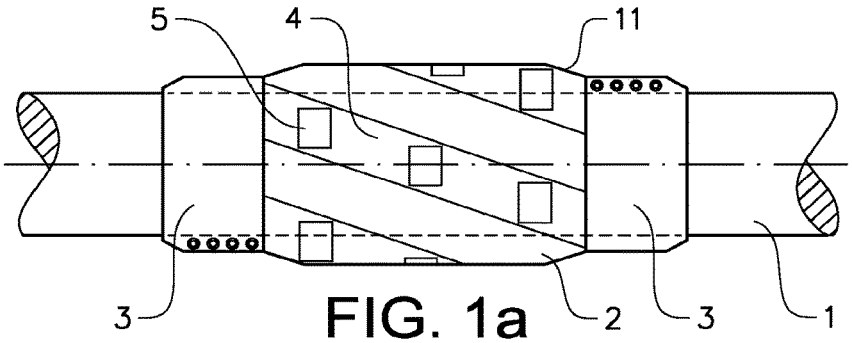
FIGS. 1*a-d* show four different side elevations of the centralizer comprising a centralizer body provided with a centre tube, a split tube, outer centralizer blades comprising rollers, and two stop collars in perspective, exploded and sectional views, respectively.

As illustrated in FIG. 1*a-e*, the present invention comprises four main components, that is, a centralizer body 2, a separate split inner tube 8, a centre tube 9 which can as an alternative be an integrated part of the centraliser body 2, and a stop collar 3. As shown in FIG. 1*a*, identical stop collars 3 are positioned at each end of the centralizer body 2.

The centralizer body 2 is fixedly mounted around a casing 1 located in a borehole during a drilling operation. The centralizer body 2 comprises a separate split inner tube 8 and is provided with a plurality of outer centralizer blades 4 arranged in an inclined, helical manner to the longitudinal axis thereof. In FIG. 1*e* four centralizer blades 4 are shown but this number may be varied according to the application of the centralizer. The separate inner tube is secured to the casing by means of a press fit. As already mentioned above, the inner surface of the centralizer body 2, the entire centre tube 9 and the outer surface of the separate split inner tube 8 facing each other are made from a suitable low friction material, such as Teflon™ or nylon. This arrangement allows for a reduction of rotational friction between the centralizer body 2, the centre tube 9 and the split inner tube 8 and ensures that no rotation occurs between the casing 1 and split inner tube 8, thereby preventing undesired wear on the pipe string outer diameter.

The split inner tube 8 is provided with a longitudinal split 12 allowing it to be expanded and placed over the casing 1 into the selected position. The split inner tube 8 is made slightly under gauge and clamps around the outer diameter of the casing by a force caused by the resilient properties of split inner tube 8 as the force expanding the split inner tube 8 is released. The grip of the split inner tube 8 is enhanced by an inner surface made from high friction material, such as brake band materials or a soft metal (e.g. aluminium). This low friction tube is placed around the casing to act as a bearing face about which the centralizer body and the low friction centre tube 9 in can be rotated. The intention is to protect from wear during rotation and create a rotational surface outside the casing with very low resistance to the revolving inner centralizer surface. Having positioned the split inner tube 8 in the correct area, the centralizer body 2 and the centre tube 9 is slid over the split inner tube 8 and secured in place by a stop collar 3 on each side of the centralizer body 2.

Each end of the centralizer body 2 is equipped with an annular low friction ring 7 in order to reduce the rotational friction between the centralizer body 2 and the stop collars 3. The low friction material centre tube 9 is formed by a cylindrical body placed between the split tube 8 and the centralizer body 2. A stop collar overlap 6 is formed by allowing each end of the centralizer body 2 to extend axially past the ends of the cylindrical low friction centre tube 9. The ends of the cylindrical low friction centre tube 9 forms an annular stop, against which the respective annular low friction rings 7 and the stop collars 3 are positioned. The stop collar overlap 6 reduces the amount of particles to enter the bearing faces between the inner split tube 8, the centre tube 9 and the centralizer body 2, and the stop collars 3 and the low friction end rings 7, respectively.

According to a further example, the ends of the stop collar 3 facing the centralizer body 2 can be provided with a low friction coating or be made from a suitable low friction material (not shown).

The centralizer body 2 is equipped with protruding portions 5 formed in the helical centralizer blades 4. The curved blades give better circular coverage which makes stand off less dependent on the position of the centralizer in the borehole. The protruding portions reduce the sliding resistance and each are made in the form of an oval formed roller 10 to avoid point loading on the edge of the roller in a curved borehole. The roller 10 is supported by means of an axle (see FIG. 1*f*) mounted in a recess in the centralizer body 2 and extends a predetermined radial distance out of a roller opening. The outer diameter of the roller 10 is larger than the width of the roller opening in the axial direction of the centralizer body. This arrangement removes the possibility of the rollers falling out of the centralizer body into the borehole and becoming an operational hazard.

A bevel 11 at each end of the centralizer functions as a guide if encountering cuttings beds and reduces the risk of hanging up on ledges or sharp edges while running in or pulling out of a borehole.

Figure 1B:
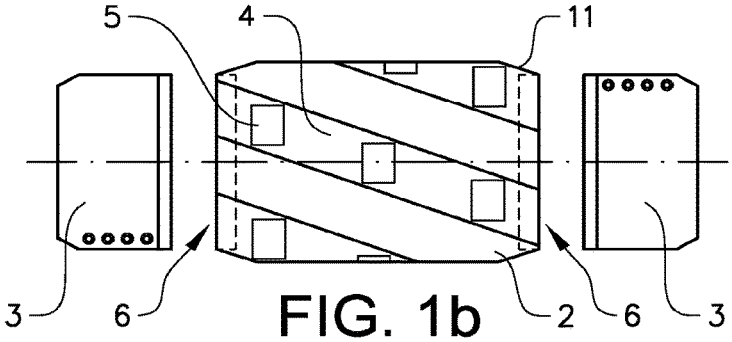
Figure 1C:
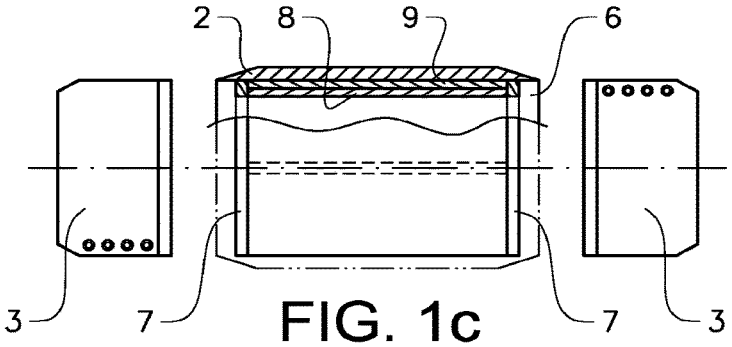
Figure 1D:
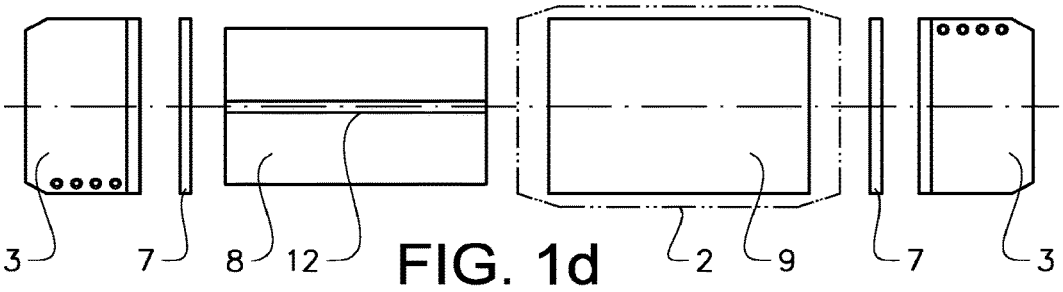
Figure 1E:
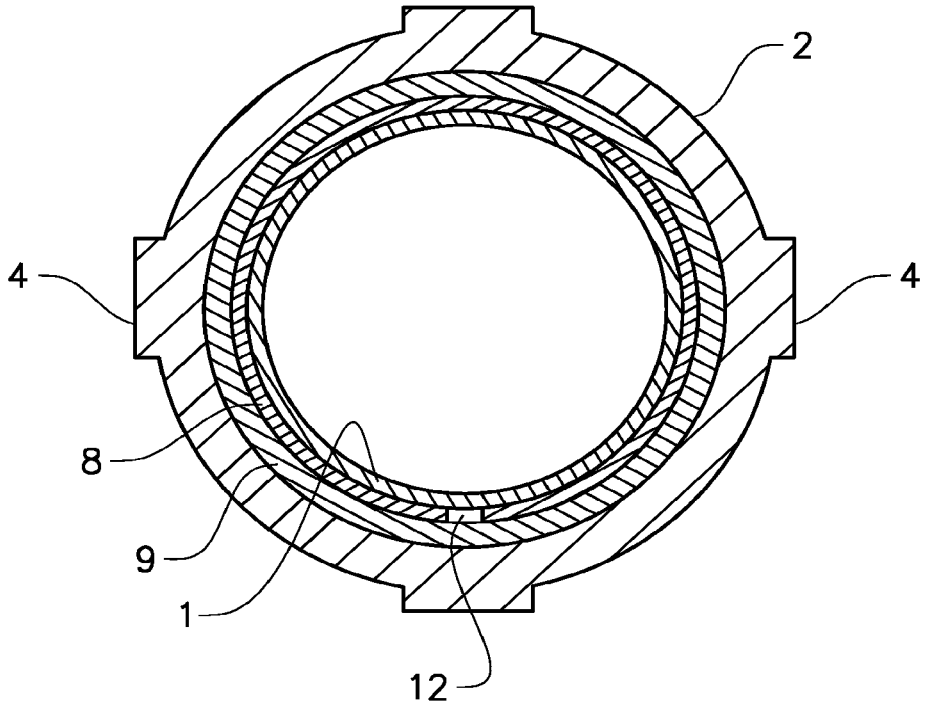
FIG. 1*e* shows an end elevations of the centralizer comprising a centralizer body provided with an separate split inner tube, centre tube, outer centralizer blades comprising rollers, and two stop collars in perspective, exploded and sectional views, respectively.
Figure 1F:
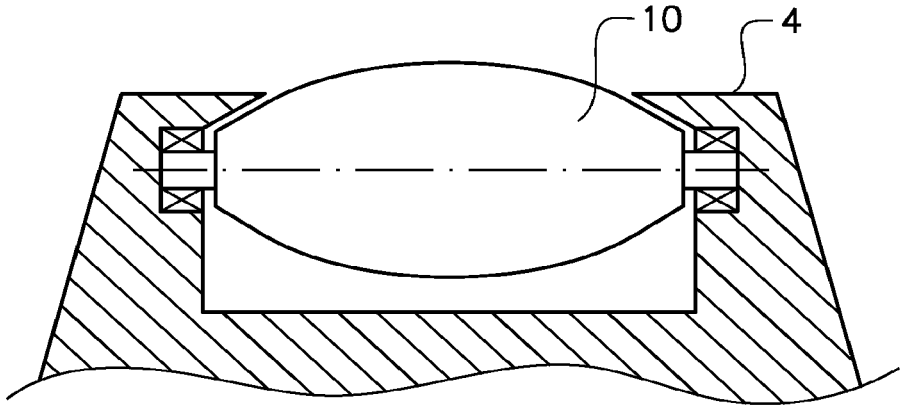
FIG. 1*f* shows a side elevation of a oval roller arrangement inside a recess in the centraliser protruding blade

As indicated in FIG. 1*f*, each protruding portion can be in the form of a roller, such as a failsafe oval formed roller with an outer surface having a minimum diameter at each end and a maximum diameter at its middle section. The roller is journalled in bearings at each end and is arranged with its central axis at right angles to the central axis of the centralizer. The rollers are installed in recesses inside the blades and extend radially outwards through openings in the outer circumferential surface of the blades. These openings are smaller than the roller outer diameter at each point along its length. The roller can be located in a recess machined into the inner surface of the centralizer body, which recess opens out through the outer surface of the centralizer blade. The shape of the opening is arranged to conform with the outer contour of the roller extending a predetermined radial distance out of the opening.

Figure 2:
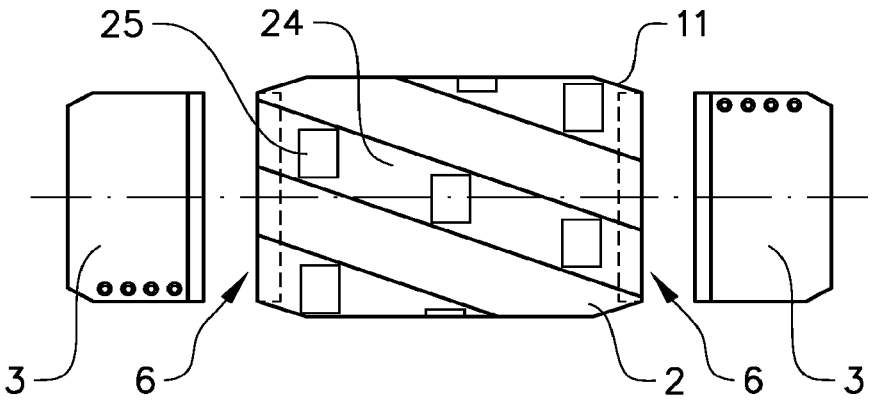
FIG. 2 shows the same view as FIG. 1*b*, where the rollers have been replaced by a low friction coating or pads.

FIG. 2 shows an alternative embodiment of the invention as shown in FIG. 1*b*. In FIG. 2 each of the protruding portions indicated by reference numeral 5 in FIG. 1*b* are replaced by a pad 25 made from a suitable low friction material sunk into the outer surface of the blade 24 or a raised surface provided with a coating made from low friction material. The remaining numerals are identical to those used in FIG. 1*b*. The pad 25 or the raised, coated surface protrudes a predetermined radial distance from the outer surface of the blade 24. The low friction pad or coating reduces the sliding resistance between the centralizer and the borehole. The pad or coating is given an oval shape conforming to the diameter of the borehole to avoid a point loading from being applied on the pad or coating by the wall of the borehole.

The outer diameter and inner diameters of the centralizer in the above embodiments are matched to the casing size. The centralizer inner diameter normally ranges from 4" to 20" and the centralizer outer diameter ranges from 6" to 24". The length of the centralizer can vary somewhat with its inner diameter but will typically range from 15" to 30".

Figure 3:
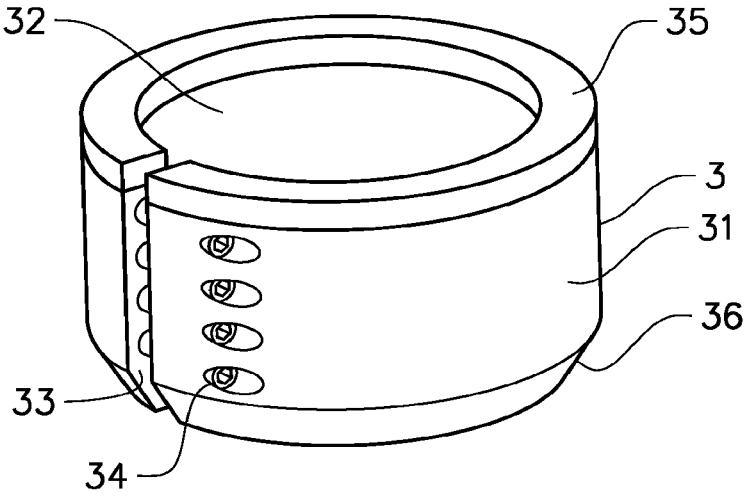
FIG. 3 shows a side elevation of the stop collar in perspective view.

As shown in FIG. 3, the stop collar 3 comprises a split main body 31, which is to be slid on to the casing, and a number of fastening screws 34 arranged in a tangential direction at right angles to the central axis of the main body 31. The fastening screws 34 extend across a gap 33 formed by the split portion of said main body 31, but do not protrude outside the outer diameter thereof. A stop collar is slid onto the casing the end of a casing section to a selected position. When the fastening screws 34 are tightened, the inner diameter of the stop collar 3 is reduced and the stop collar is clamped around the casing to ensure that the contact between the pipe string casing and stop collar is as tight as possible. A high friction internal surface 32 of the stop collar is provided to increase the resistance to movement between stop collar and the casing after the stop collar has been fixed firmly in place. The stop collar 3 is also formed with a bevel configuration 36 at the end remote from the centralizer body and has a low friction ring 35 at the end surface facing the centralizer body. The low friction ring 35 can be used in place of or as a supplement to the low friction ring 7 mentioned in connection with FIGS. 1*a*-1*e* above. The low friction ring 35 is installed against the centralizer and ensures that the friction between the stop collars and the centralizer assembly is kept as low as possible when the pipe string casing is rotated. The bevel 36 on the stop collar is arranged to guide the pipe string if ledges are encountered in the borehole and reduces the risk of hang up during operations.

The outer diameter and inner diameters of the stop collar in the above embodiments are matched to casing size. The stop collar inner diameter normally ranges from 4" to 20". The length of the stop collar can vary somewhat with its inner diameter but will typically range from 2" to 6".

The invention claimed is:

1. A centralizer comprising a centralizer body to be situated at the outer surface of a pipe string in the form of casing or liner used while drilling, the centralizer body being formed with a plurality of outer centralizer blades arranged in an inclined manner to the longitudinal axis of the centralizer, wherein the centralizer comprises a split inner tube secured to the pipe string, wherein the centralizer body is arranged to be rotatable around the split inner tube, wherein the centralizer further comprises a centre tube provided between the centralizer body and the split inner tube, wherein facing surfaces on the centre tube and the centralizer body and the split inner tube comprise a low friction material, wherein the centralizer further comprises a first stop collar and a second stop collar, the first and second stop collars being arranged at opposite ends of said centralizer body, the centralizer body being arranged to be rotatable relative to said first and second stop collars, wherein at least one end surface on the centralizer body and/or the first and second stop collars comprises a low friction material, and wherein the centralizer body includes a first recess and a second recess at opposite ends thereof, ends of each of the first and second stop collars facing the centralizer body are accommodated within the first and second recesses, respectively, and the first and second stop collars are separately secured about the pipe string to hold the centralizer in place.

2. The centralizer according to claim 1, wherein an annular ring coated with or made of the low friction material is situated between the centralizer body and at least one stop collar of the first and second stop collar.

3. The centralizer according to claim 1, wherein each of the first and second stop collars is provided with a bevel at the end remote from the centralizer body.

4. The centralizer according to claim 1, wherein each of the first and second stop collars comprises a split main body with a longitudinal gap provided with a fastening device configured to fix the first and second stop collars to the pipe string, and an inner surface made from a high friction material.

5. The centralizer according to claim 1, wherein the outer centralizer blades are provided with at least one outer protruding portion.

6. The centralizer according to claim 5, wherein each protruding portion is provided with a coating made of low friction material.

7. The centralizer according to claim 5, wherein each protruding portion is in the form of a pad made of low friction material.

8. The centralizer according to claim 5, wherein each protruding portion is in the form of a roller.

9. The centralizer according to claim 8, wherein each roller is located in a recess in the centralizer body and extends a predetermined distance radially outwards from said centralizer blades.

10. The centralizer according to claim 8, wherein each roller extends radially outwards through an opening in the outer circumferential surface of the centralizer blades, and that the opening is smaller than the roller outer diameter at each point along its length.

11. The centralizer according to claim 8, wherein each roller has an oval basic shape.

12. The centralizer according to claim 1, wherein the outer centralizer blades are formed with a curved or helical configuration.

13. The centralizer according to claim 1, wherein the separate split inner tube comprises a longitudinal split and an inner surface made from high friction material allowing for the press fit against the pipe string.

14. The centralizer according to claim 1, wherein each of the first and second stop collars comprises a first surface arranged to face the pipe string and a second surface arranged to face the centralizer body, wherein the first surface is made of a first material and the second surface is made of a second material, and wherein the first material has a higher friction coefficient than the second material.

15. The centralizer according to claim 1, wherein the split inner tube comprises an inner surface made of a first material, wherein the split inner tube comprises an outer surface made of a second material, and wherein the first material has a higher friction coefficient than the second material.

* * * * *